US007856675B1

(12) United States Patent
Couturier et al.

(10) Patent No.: US 7,856,675 B1
(45) Date of Patent: Dec. 28, 2010

(54) FLUSH PASSAGE VENTILATION FITTING

(76) Inventors: Alvin A. Couturier, 13114 Staton Dr., Austin, TX (US) 78727-4580; John Thomas Pullicino, 13114 Staton Dr., Austin, TX (US) 78727-4580

( * ) Notice: Subject to any disclaimer, the term of this patent is extended or adjusted under 35 U.S.C. 154(b) by 1128 days.

(21) Appl. No.: 11/527,138

(22) Filed: Sep. 26, 2006

Related U.S. Application Data

(60) Provisional application No. 60/720,606, filed on Sep. 26, 2005.

(51) Int. Cl.
*E03D 9/04* (2006.01)

(52) U.S. Cl. ..... 4/213; 4/216

(58) Field of Classification Search ..... 4/209 R, 4/213, 216, 218, 219; 137/119.06
See application file for complete search history.

(56) References Cited

U.S. PATENT DOCUMENTS 5,353,443 A * 10/1994 Sim ..... 4/216
5,738,135 A * 4/1998 Johnson ..... 137/119.06
5,991,933 A 11/1999 Schaffer
6,088,845 A 7/2000 Estrada
6,370,703 B1 * 4/2002 Kim et al. ..... 4/216
6,463,595 B2 10/2002 Prisco
6,694,534 B2 2/2004 Stone

* cited by examiner

*Primary Examiner*—Tuan N Nguyen

(57) ABSTRACT

This invention relates to the direct evacuation of malicious odor found within restroom toilets and urinals. This design is aesthetically appealing, multi-usable, professional grade solution that provides the removal of malicious odors from standard toilet bowls and urinals while not requiring additional routine maintenance or reoccurring filter costs further promoting a clean healthy hassle-free restroom facility. Moreover, this invention removes the prior art necessity of requiring a localized power source and provides protection against water from being drawn into the electrical exhaust system further protecting users from health hazards during operation. This device will function within multiple applications such as reservoir and pressurized systems that provide flushing pressure for toilets and urinals. This invention was designed to eliminate odor backflow within shared exhaust systems which prior art could not attain thus allowing this design to function within multiple inline unit configurations providing a no-nonsense cost-effective commercial integration into hotels, apartment complexes, and large-scale commercial buildings and developments.

20 Claims, 15 Drawing Sheets

FLUSH PASSAGE VENTILATION FITTING

CROSS-REFERENCE TO RELATED APPLICATIONS

This application claims the benefit of PPA Ser. No. 60/720,606 filed Sep. 26, 2005, by the present inventors.

FEDERALLY SPONSORED RESEARCH

Not Applicable

SEQUENCE LISTING OR PROGRAM

Not Applicable

BACKGROUND OF THE INVENTION

1. Field of Invention

This invention relates to the direct evacuation of malicious odor found within restroom toilets and urinals.

2. Prior Art

Prior art techniques relating to the removal of malicious odor are designed to alleviate odor by utilizing devices attached to the waste receptacles via in-tank and external designs. To diminish the malicious odor these designs rely on filtering and/or evacuation of the surrounding area thus attempting to provide fresh air within bathroom facilities.

Filtering systems mounted to the toilets exterior are very unsightly and intrusive objects that attempt to collect the malicious odor by using specialized seats and/or oddly shaped venting apparatuses that are exposed to human waste which inadvertently create routine cleaning hazardous to the user. Moreover, both in-tank and external filtration designs have the same major drawbacks; they require a localized power source to operate, create additional unnecessary routine maintenance, and are commercially infeasible to implement since multiple inline unit configurations are unattainable while being incapable of supporting tank-less pressurized flushing systems.

U.S. Pat. No. 6,694,534 B2 issued on Feb. 24, 2004 to Earlyn W. Stone shows a prior art example of an in-tank filtration design that tries to clean the odor by filtering and re-circulating the malicious odor. Stone's design is not an effective approach in eliminating malicious odor from restroom facilities because this device could expand the surrounding area of malicious odor if costly filters are not changed on a routine basis. This device is also a hazardous threat to its operators since it requires a specialized battery and/or power source to operate within close proximity to a water source and the operator. Furthermore, commercial integration is infeasible since this invention cannot be used within multiple unit configurations, creates additional routine maintenance, and is incapable of supporting standard tank-less pressurized flushing systems.

U.S. Pat. No. 6,209,146 B1 issued on Apr. 3, 2001 to Arturo Gonzalez offers an unsightly external filtration system that filters and re-circulates the malicious odor. This unsightly design is exposed to human waste thus creating health hazards during routine cleaning. Additionally, the required voltage interface is within close proximity to the user further providing a health hazard during operation. Furthermore, commercial viability is infeasible as this design is incapable of multiple inline unit configurations, creates additional routine maintenance and cannot remove odor within standard urinals and pressurized flushing systems.

Evacuation systems also have in-tank and external designs that try to eliminate malicious odor. Unfortunately, these designs still need specialized toilet seats and/or oddly shaped venting apparatuses that are exposed to human waste which inadvertently create routine cleaning hazardous to the user. Moreover, both in-tank and external evacuation designs have the same major drawbacks; they are commercially infeasible to implement within multiple inline unit configurations because odor backflow issues have not been addressed and are incapable of supporting standard tank-less pressurized flushing systems.

U.S. Pat. No. 5,991,933 issued on Nov. 30, 1999 to Richard C. Schaffer shows prior art that tries to alleviate odor by an in-tank apparatus that functions by evacuating malicious odor through the flush passage of a toilet. Unfortunately, during an overflow situation where excess tank water drains into the flush passage there is no defense against the suction of water into the exhaust system. Ultimately, a continued presence of water within the exhaust system will eventually render the evacuating system useless. This design is incapable of multiple unit configurations because backflow issues were not taken into account during the design process. If this design were commercially implemented in a multiple inline unit configuration, where a common exhaust system exists, backflow of malicious odor into adjacent inline units would occur since there is no backflow protection. Without backflow protection, this invention is commercially infeasible and very costly to implement while providing no capabilities for odor removal within urinals and pressurized flushing systems.

U.S. Pat. No. 6,463,595 B2 issued on Oct. 15, 2002 to Anthony Prisco is an external apparatus that functions by evacuating malicious odor away from toilets. Unfortunately, this design does not fully function when the toilet seat is lifted because the odor inlets are not optimally positioned to evacuate malicious odor present within the bowl. Its unnecessarily large and unsightly design inadvertently creates a health hazard during routine maintenance since this apparatus and its associated odor inlets are exposed to human waste. Moreover, this design failed to gain commercial acceptance because backflow issues have not been addressed and cannot fully support standard tank-less pressurized flushing systems such as commercial toilets since the system loses optimal placing of odor inlets when the seat is in the upright position.

U.S. Pat. No. 6,088,845 issued on Jul. 18, 2000 to Juan Jose Hugo Ceja Estrada shows an external apparatus that functions by evacuating malicious odor away from a non-standard urinal and toilet. If this design were implemented within a commercial environment where multiple inline units share a common exhaust system this design would allow for the backflow of malicious odor into adjacent inline units since there is no backflow control. Without backflow protection, this device is commercially infeasible and very costly to implement since this design requires the use of non-standard toilets and urinals that have separate odor inlets and passageways installed within.

In conclusion, prior art focused on the elimination of malicious odor present within restroom facilities were unsuccessful in resolving the very issue they were designed to solve. These prior art designs failed to meet commercial success because they have reoccurring filter costs, do not provide a professional installation and/or aesthetic appeal, and in many cases hazardous to human health. Furthermore, these designs failed to gain commercial acceptance because backflow issues have not been addressed and cannot function within multiple inline unit configurations and are incapable of fully supporting standard tank-less pressurized flushing systems such as commercial toilets and urinals.

OBJECT AND ADVANTAGES

The unique design of this invention permits the efficient and effective removal of malicious odor from toilet bowls and urinals within restroom facilities. Its streamlined design provides a professional grade solution that permits an aesthetically appealing installation, does not require additional routine maintenance or reoccurring filter costs, and eliminates the need for additional apparatuses exposed to human waste, which further promotes a clean healthy hassle-free restroom facility. With the removal of specialized seats and/or oddly shaped apparatuses and eliminating the necessity for a localized power source this invention is completely harmless to its users.

As this invention promotes clean sanitary conditions it also provides a professional grade installation contrasting to prior art requiring assembly of multiple parts and wiring diagrams. Along with ease of installation, this design provides the first "professional looking" design that is aesthetically pleasing to its end users and provides the capability of fully functioning within many different applications ranging from standard home toilets with water tanks to standardized commercial facilities using pressurized flushing apparatus such as toilets and urinals. Additionally this invention takes into account other important aspects that were missed with prior art.

Firstly, this invention has provided a defense against the suction of water into the exhaust system that prior art has failed to meet. This very important detail will assure that the exhaust system will be devoid of water at all times thus eliminating the risk of an electrical fire within inline exhaust components such as electric blowers. Secondly, the flexibility of this single invention fully functions while being incorporated into various configurations which prior art could not achieve without separate designs and/or additional equipment or requiring the use of non-standard toilets or urinals. Thirdly commercial viability, this design provides the capabilities for multiple inline unit configurations by removing possible back-flowing odor within exhaust systems that prior art simply could not attain. As such, multiple inline unit installations can expel odor into one exhaust system and will not inadvertently force odors into another restroom facility not currently in use while other facilities are. This elimination of odorous backflow within multiple inline unit configurations allows for cost effective commercial acceptance into hotels, apartment complexes, and large-scale commercial buildings and developments further promoting the commercial success of this invention.

This designs aesthetically appealing, multi-usable, professional grade solution will provide a no-nonsense approach for market adoption and customer acceptance for the direct evacuation of malicious odor found within restroom toilets and urinals.

SUMMARY

This aesthetically appealing, multi-usable, professional grade solution efficiently and effectively removes malicious odors from standard toilet bowls and urinals while not requiring additional routine maintenance or reoccurring filter costs further promoting a clean healthy hassle-free restroom facility. Moreover, this invention removes the prior necessity of requiring a localized power source and provides protection against water from being drawn into the electrical exhaust system further protecting users from health hazards during operation. Additionally, by removing the possibility of back-flowing odor within shared exhaust systems that prior art could not attain this design can function in multiple inline unit configurations thus providing a no-nonsense cost-effective commercial integration into hotels, apartment complexes, and large-scale commercial buildings and developments.

DRAWINGS

Figures.

In the drawings, closely related figures have the same numbers but different suffixes.

FIG. 1 cross sectional side view of the preferred embodiment of a ventilation fitting.

Figure 1:
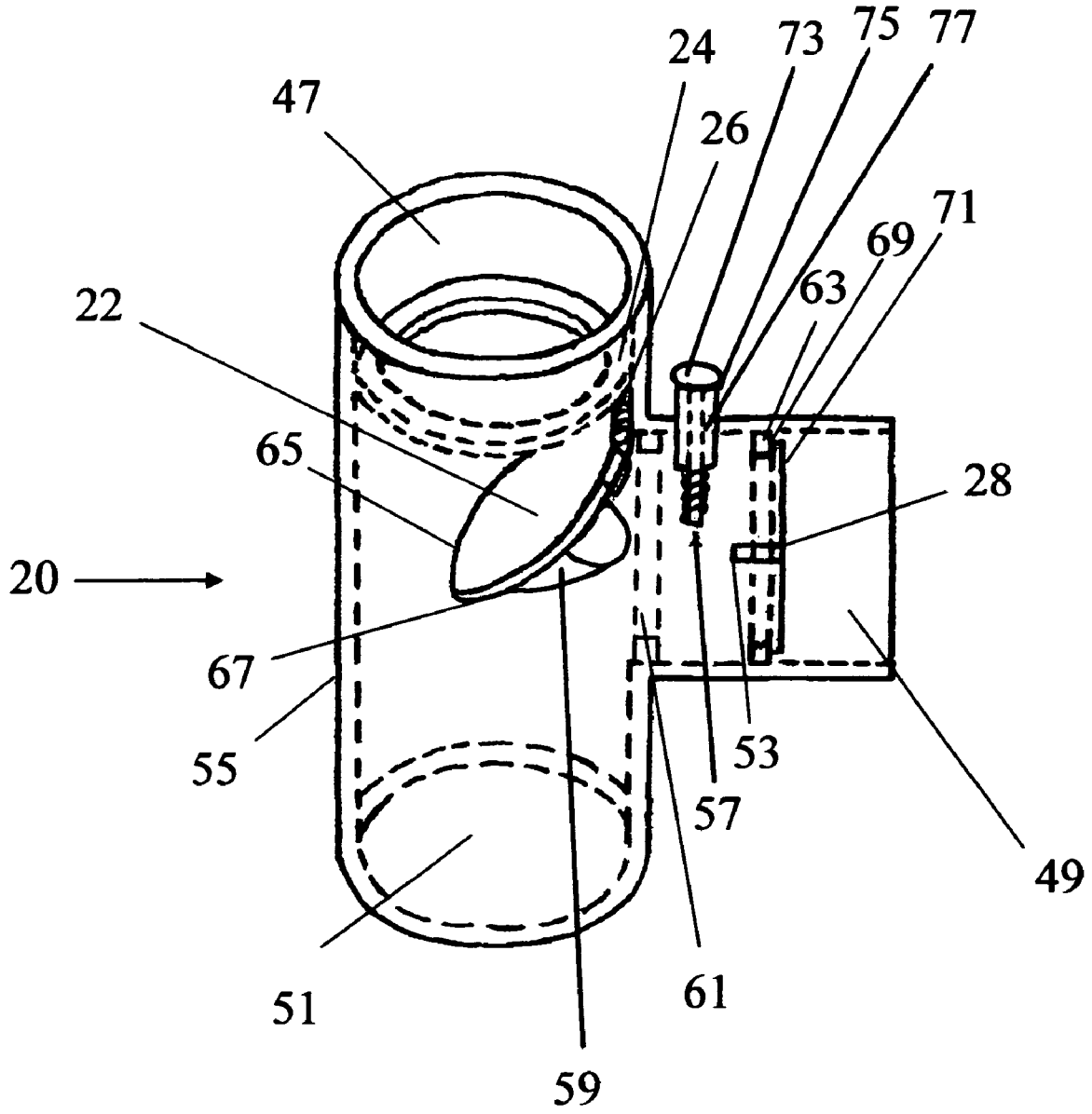

DRAWINGS - Reference Numerals.

| | |
|---|---|
| 20 | ventilation fitting - preferred |
| 21 | fluid flow |
| 22 | diverter plate |
| 23 | gaseous flow |
| 24 | inlet port seat |
| 26 | springable hinge |
| 27 | electric fan actuation plug B |
| 28 | snub plate |
| 29 | exhaust pipe |
| 30 | tank-less toilet |
| 31 | toilet seat |
| 32 | rim |
| 33 | fill valve |
| 34 | rim holes |
| 35 | fill valve float |
| 36 | flush passage |
| 37 | fill tube |
| 38 | external vent |
| 39 | fill valve primary outlet |
| 40 | roof |
| 41 | fill valve secondary outlet |
| 42 | electric fan/blower |
| 43 | tank-included toilet |

-continued

| DRAWINGS - Reference Numerals. | |
|---|---|
| 44 | electric fan/blower inlet port |
| 45 | waste cavity |
| 46 | electric fan/blower outlet port |
| 47 | inlet port |
| 48 | voltage source |
| 49 | exhaust port |
| 50 | electric fan actuation plug A |
| 51 | bidirectional port |
| 52 | electric fan actuation interface |
| 53 | springable guide |
| 54 | commercial flush valve |
| 55 | main body |
| 56 | urinal |
| 57 | plunger |
| 58 | waste pipe |
| 59 | plunger actuator |
| 60 | water source pipe |
| 61 | exhaust port seat |
| 62 | overflow tube |
| 63 | snub plate seat |
| 64 | flush linkage |
| 65 | upper surface |
| 66 | flush plunger |
| 67 | lower surface |
| 68 | ventilation fitting - alternate A |
| 69 | interior facing surface |
| 70 | fluid inlet port |
| 71 | exterior facing surface |
| 72 | flush tank reservoir |
| 73 | release port |
| 74 | flush tank handle |
| 75 | release lid |
| 76 | flush tank lever |
| 77 | release lid seat |
| 78 | fill valve inlet |
| 79 | ventilation fitting - alternate B |
| 80 | water hose |
| 81 | ventilation fitting - alternate C |
| 82 | water shut off valve |

DETAILED DESCRIPTION

Preferred Embodiment—FIG. 1.

FIG. 1 depicts a side cross sectional view of the preferred embodiment of a ventilation fitting 20 comprising of a main body 55, a diverter plate 22 with an upper surface 65 a lower surface 67 a plunger actuator 59, a springable hinge 26, a release port 73, a release lid 75, a release lid seat 77, plunger 57, and a snub plate seat 63, a snub plate 28 with an interior facing surface 69 an exterior facing surface 71, a springable guide 53, an inlet port 47, an inlet port seat 24, exhaust port 49, an exhaust port seat 61, and a bidirectional port 51.

Operation

Preferred Embodiment.

Figure 2A:
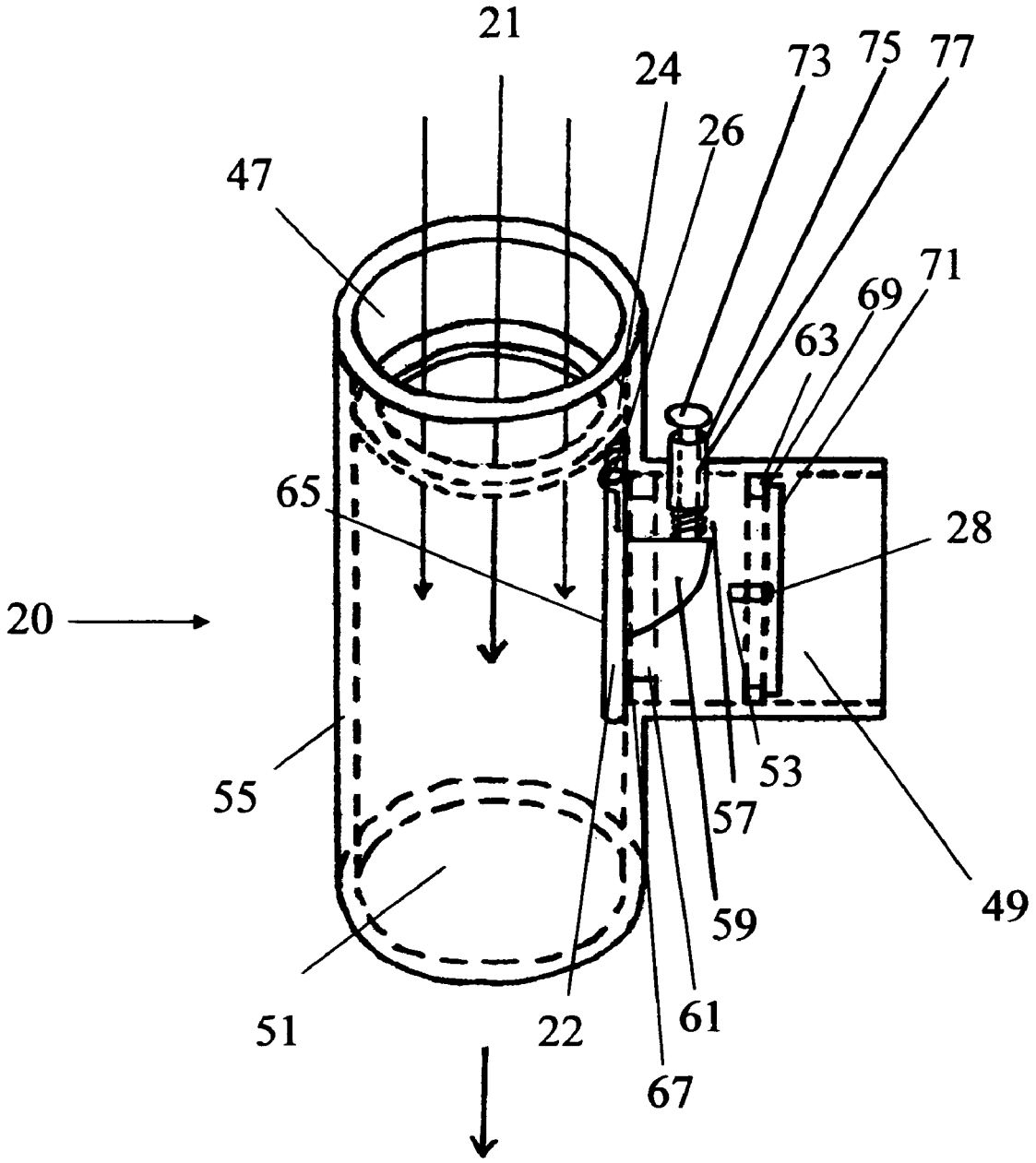
FIG. 2A to 2C shows a side cross sectional view of the operational states of the preferred embodiment of a ventilation fitting.
Figure 2B:
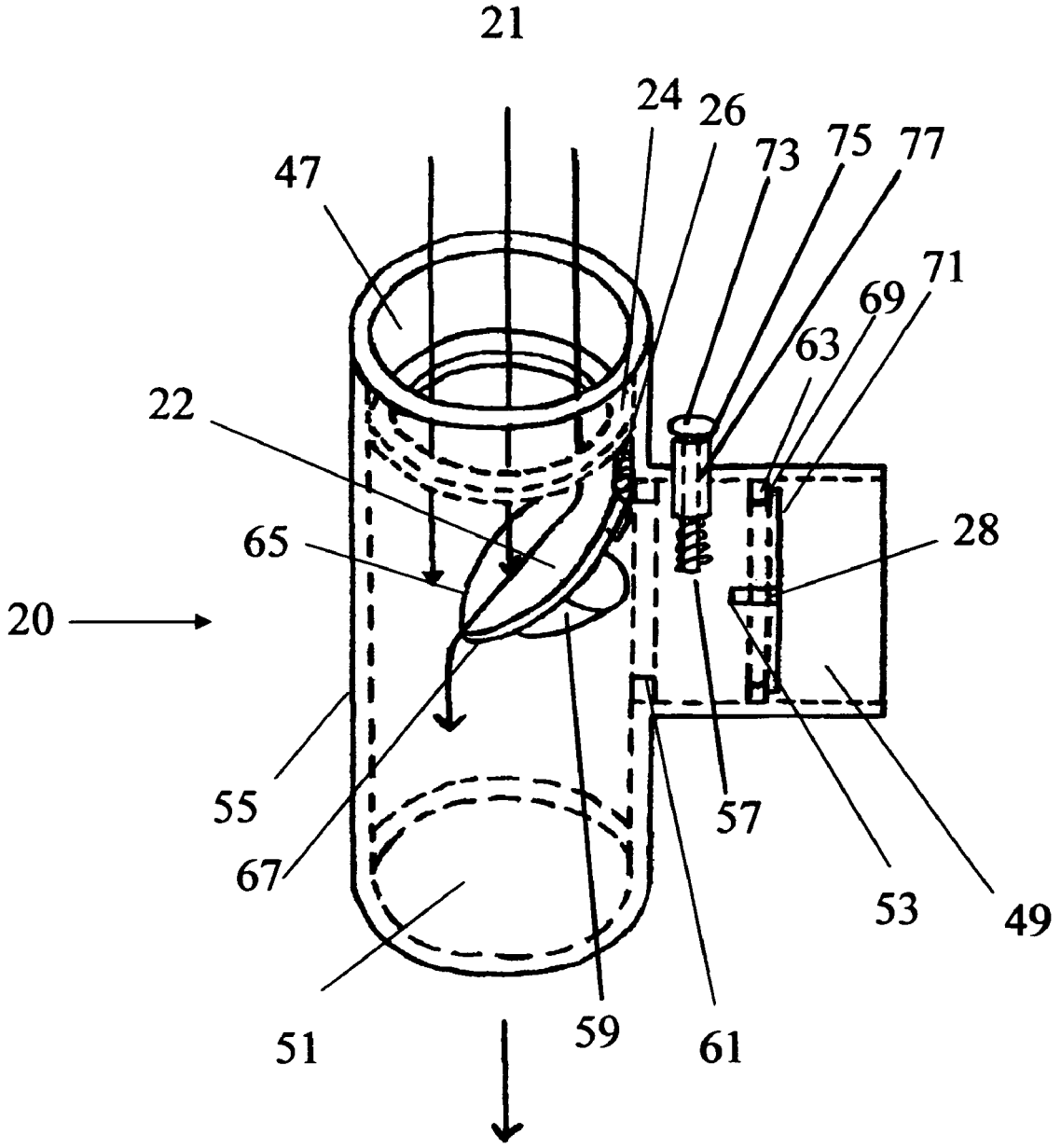
Figure 2C:
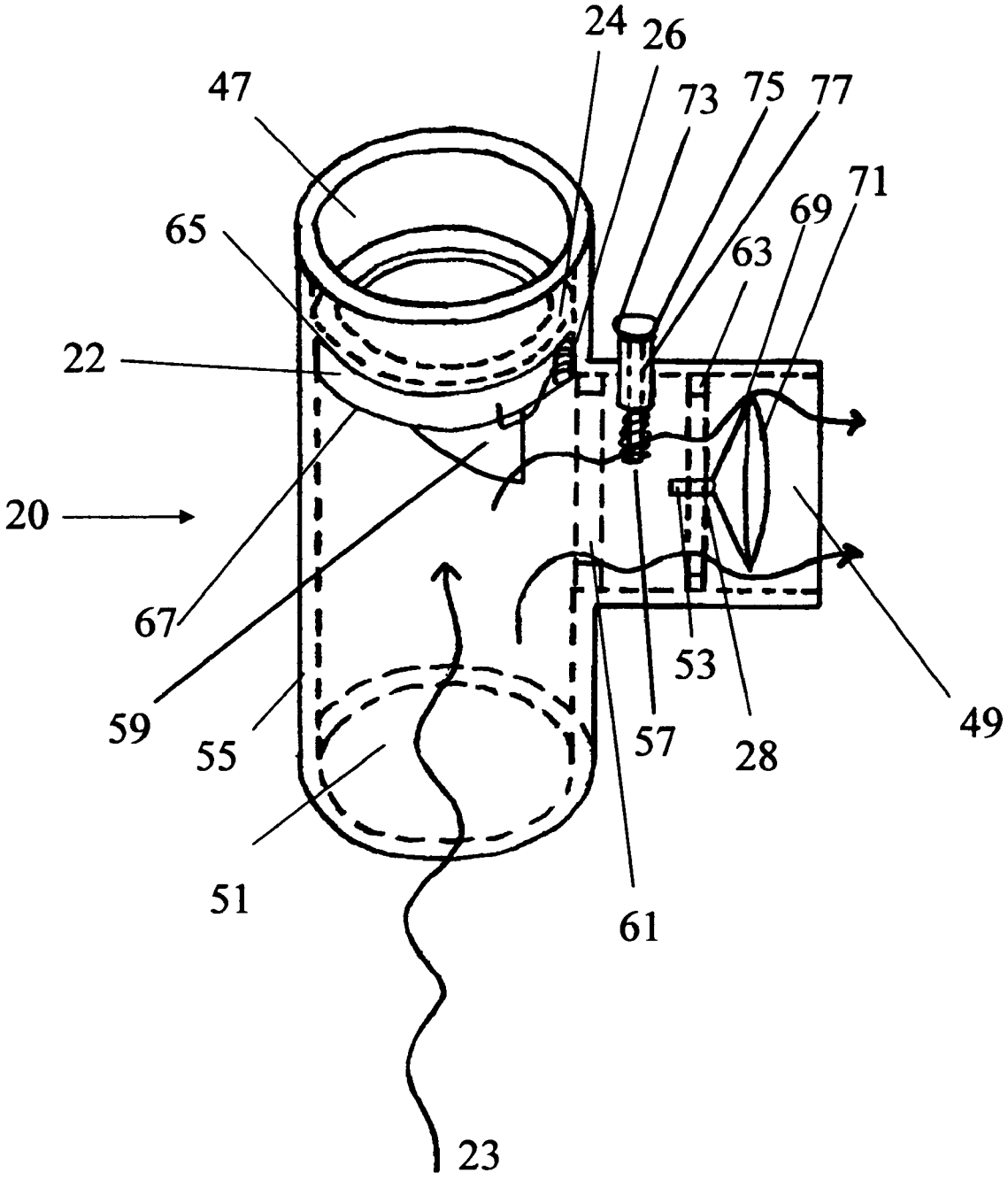

FIG. 2A-2C shows a side cross sectional view for the operational states of the ventilation fitting 20.

FIG. 2A depicts the flushing state of the ventilation fitting 20 as a fluid flow 21 provides flushing force within waste receptacle. As shown in FIG. 2A the diverter plate 22 is not seated within its inlet port seat 24 but is in fact diverting the fluid flow 21 away from the snub plate 28 and exhaust port 49 and towards the bi-directional port 51 further entering into a flush passage 36 shown in FIG. 12. The diverter plate 22 is used to prevent fluid from entering into the exhaust pipe 29 by seating against exhaust port seat 61 wherein the plunger actuator 59 presses upon plunger 57 and forces the release lid 75 to pull away from the release lid seat 77 thus decreasing suctorial forces applied onto the lower surface 67 and allowing the diverter plate to pull away from the exhaust port seat 61.

FIG. 2B depicts the transitional state of the ventilation fitting 20 finishing its flushing cycle. Within this transitional state, the water pressure is decreasing and the springable hinge 26 is now able to bring the diverter plate 22 towards its seated position within its inlet port seat 24.

Figure 12:
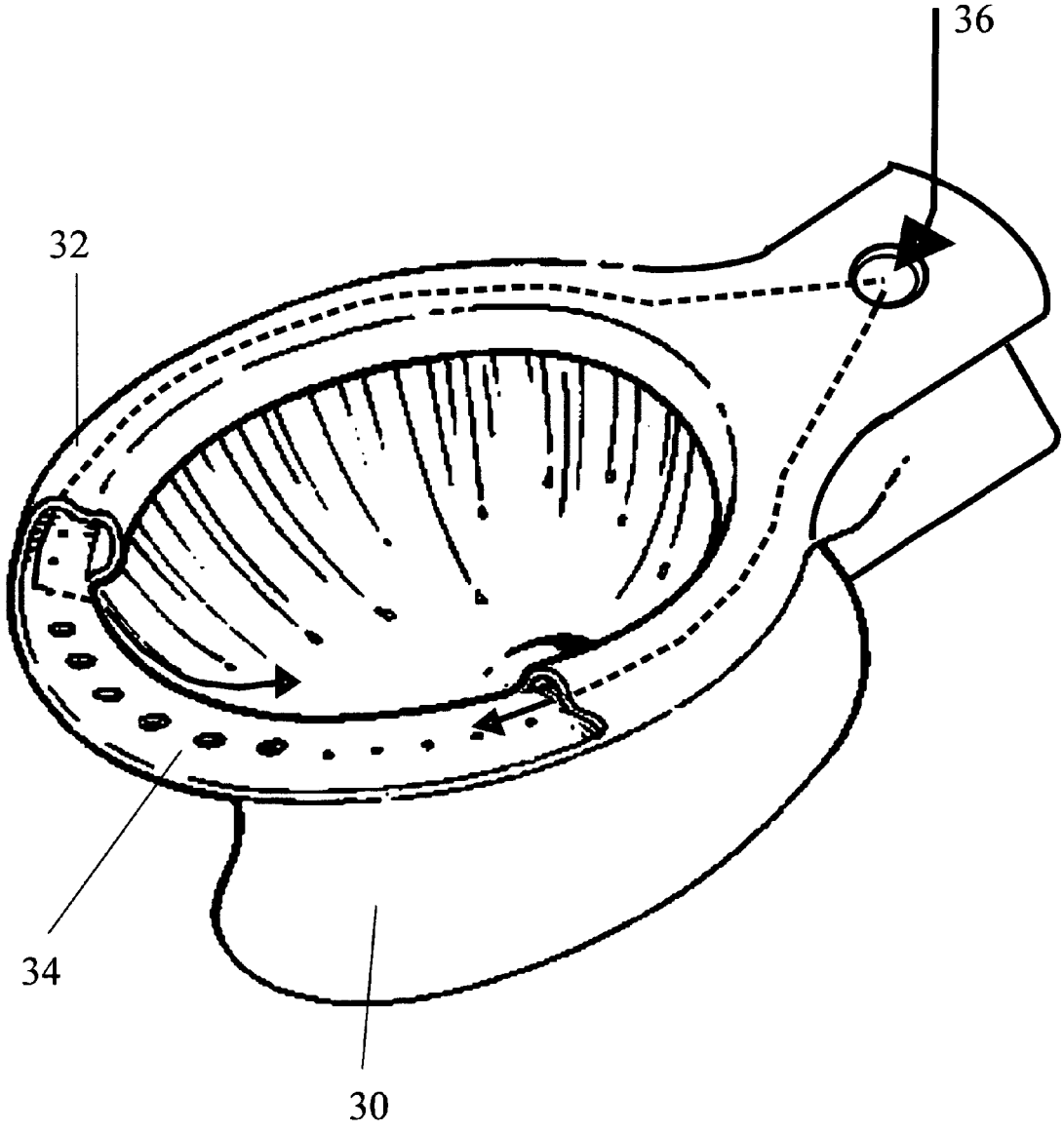
FIG. 12 shows an angled perspective of a flush passage and rim holes.

FIG. 2C shows the evacuation state as the springable hinge 26 seats the diverter plate 22 within its inlet port seat 24 and provides a direct path for the evacuation of malicious odor through the bidirectional port 51 and the flush passage 36 in FIG. 12. The evacuation of malicious odor is depicted in FIG. 2C as a gaseous flow 23, which is pumped through the flush passage 36, FIG. 12, then through the snub plate 28 as shown in FIG. 2C and out the ventilation fitting 20, exhaust port 49 and into the exhaust pipe 29 shown in FIG. 6.

Description

Alternative Embodiment—FIGS. 3-13.

Figure 3:
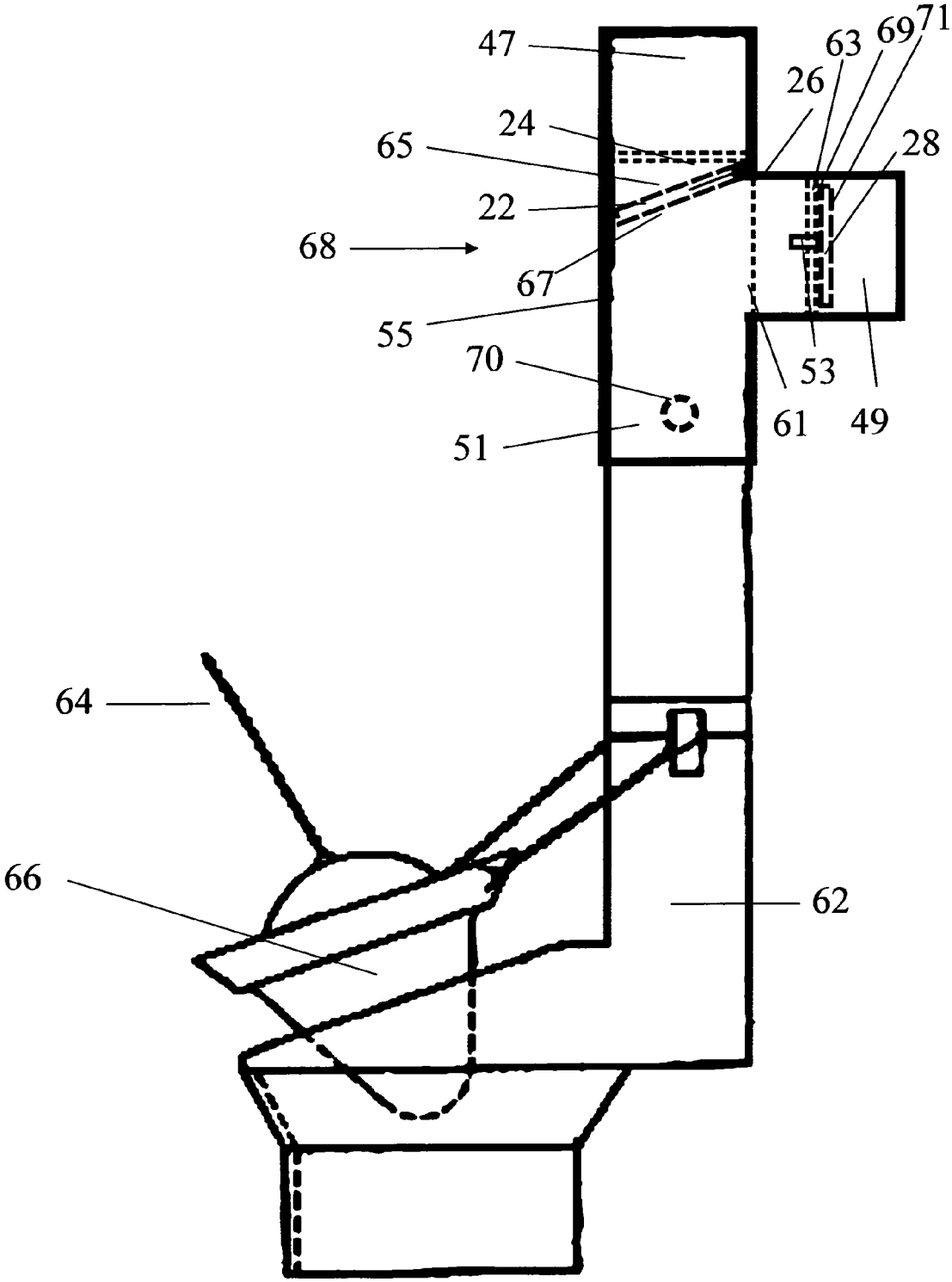
FIG. 3 shows a cross sectional side view of a ventilation fitting—alternate A fluidly connected to an overflow tube.

FIG. 3 shows a cross sectional side view of the ventilation fitting—alternate A 68 which comprising of a main body 55, a diverter plate 22 with an upper surface 65 a lower surface 67, a springable hinge 26, and a snub plate seat 63, a snub plate 28 with an interior facing surface 69 an exterior facing surface 71, a springable guide 53, an inlet port 47, an inlet port seat 24, exhaust port 49, an exhaust port seat 61, a fluid inlet port, and a bidirectional port 51 which is fluidly connected to an overflow tube 62 which has an fluidly connected flush plunger 66 and an attached flush linkage 64.

Figure 4:
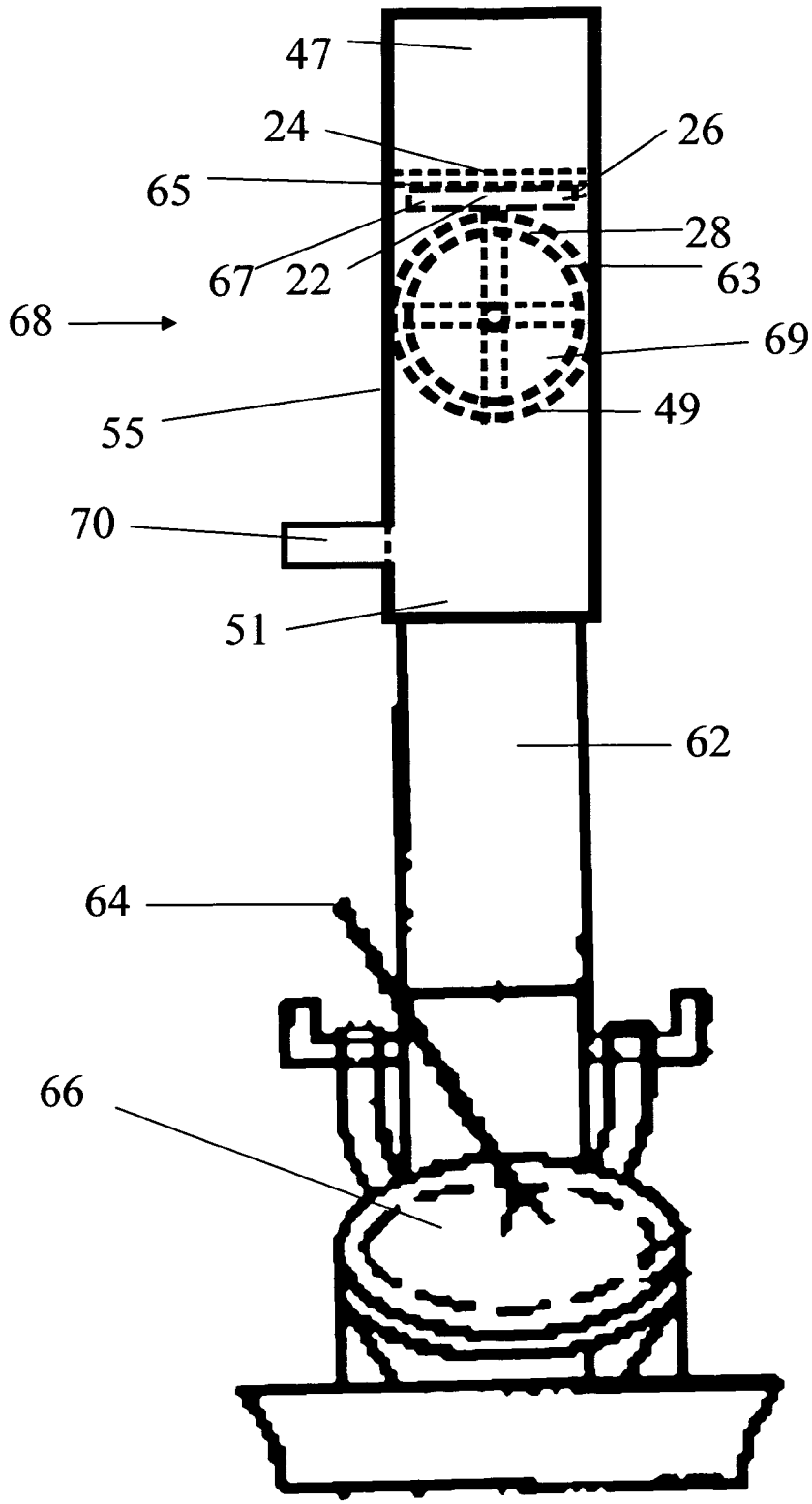
FIG. 4 shows a cross sectional front view of a ventilation fitting—alternate A fluidly connected to an overflow tube.

FIG. 4 shows a cross sectional front view of the ventilation fitting—alternate A 68.

Figure 5:
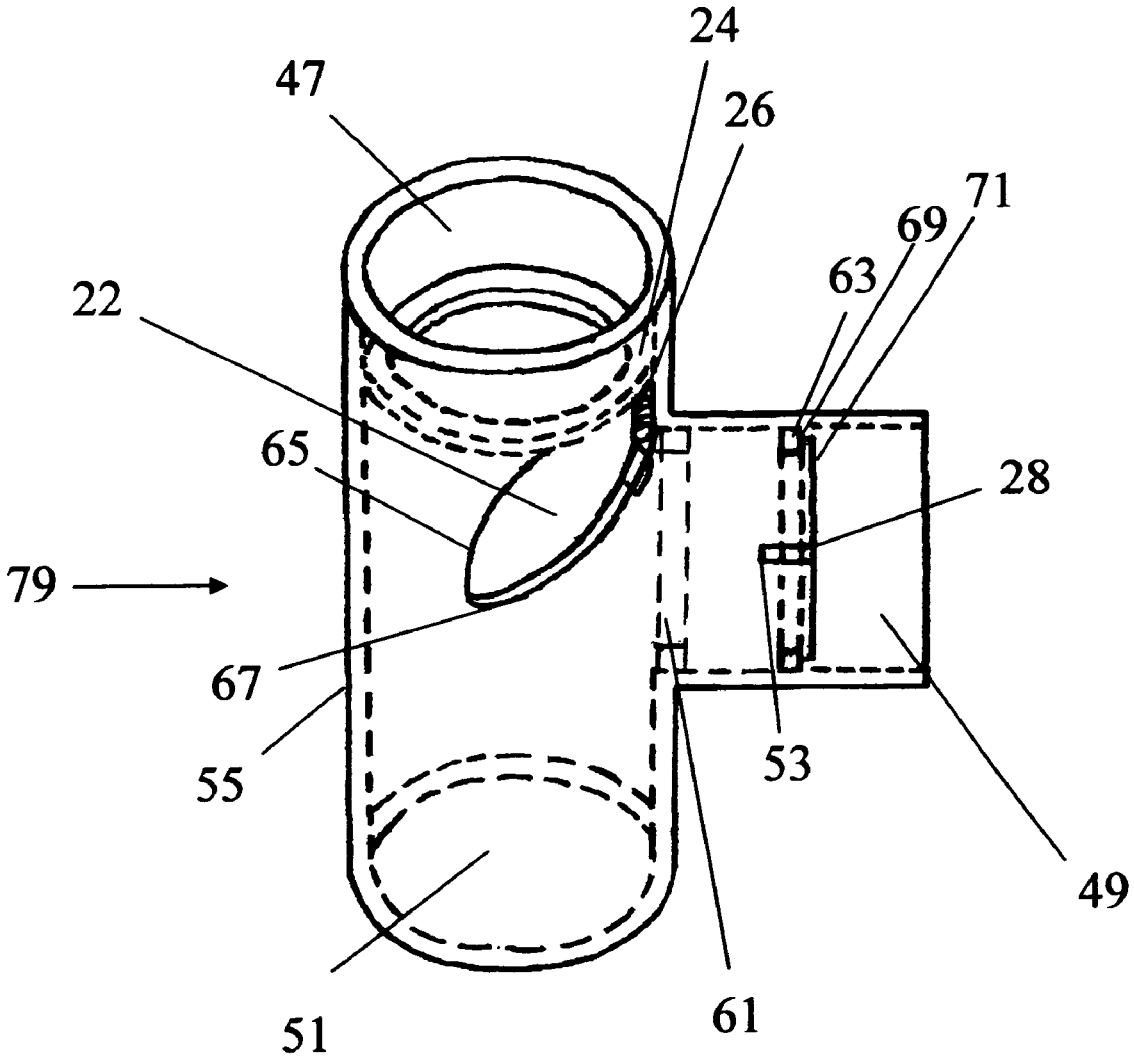
FIG. 5 shows a side cross sectional view of a ventilation fitting—alternate B.

FIG. 5 depicts a side cross sectional view of the ventilation fitting—alternate B 79.

Figure 6:
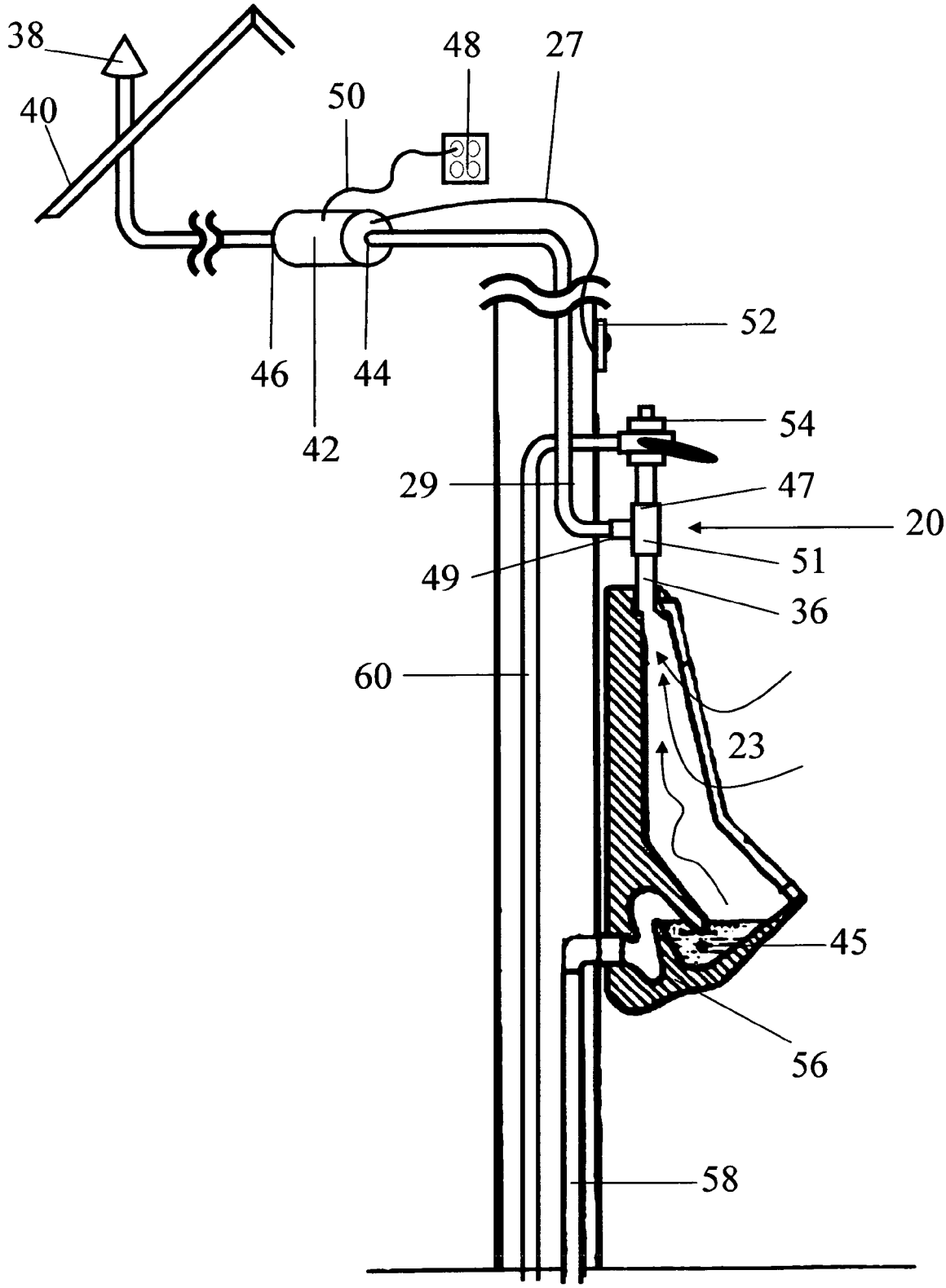
FIG. 6 shows a cross sectional side view of the preferred embodiment of a ventilation fitting utilized within a urinal configuration.

FIG. 6 depicts a cross sectional side view of the ventilation fitting 20, a commercial flush valve 54 urinal 56, a waste cavity 45 fluidly connected to a flush passage 36 and the ventilation fitting 20. The exhaust port 49 is fluidly connected to a exhaust pipe 29 that is attached to an electric fan/blower 42, electric fan/blower inlet port 44 and an electric fan/blower outlet port 46 that is then routed through a roof 40 and connected to an external vent 38. The directional arrows show the evacuation path of a gaseous flow 23. The electric fan/blower 42 has a wired connection to a voltage source 48 using actuation plug A 50 and an actuation interface 52 using actuation plug B 27.

Figure 7:
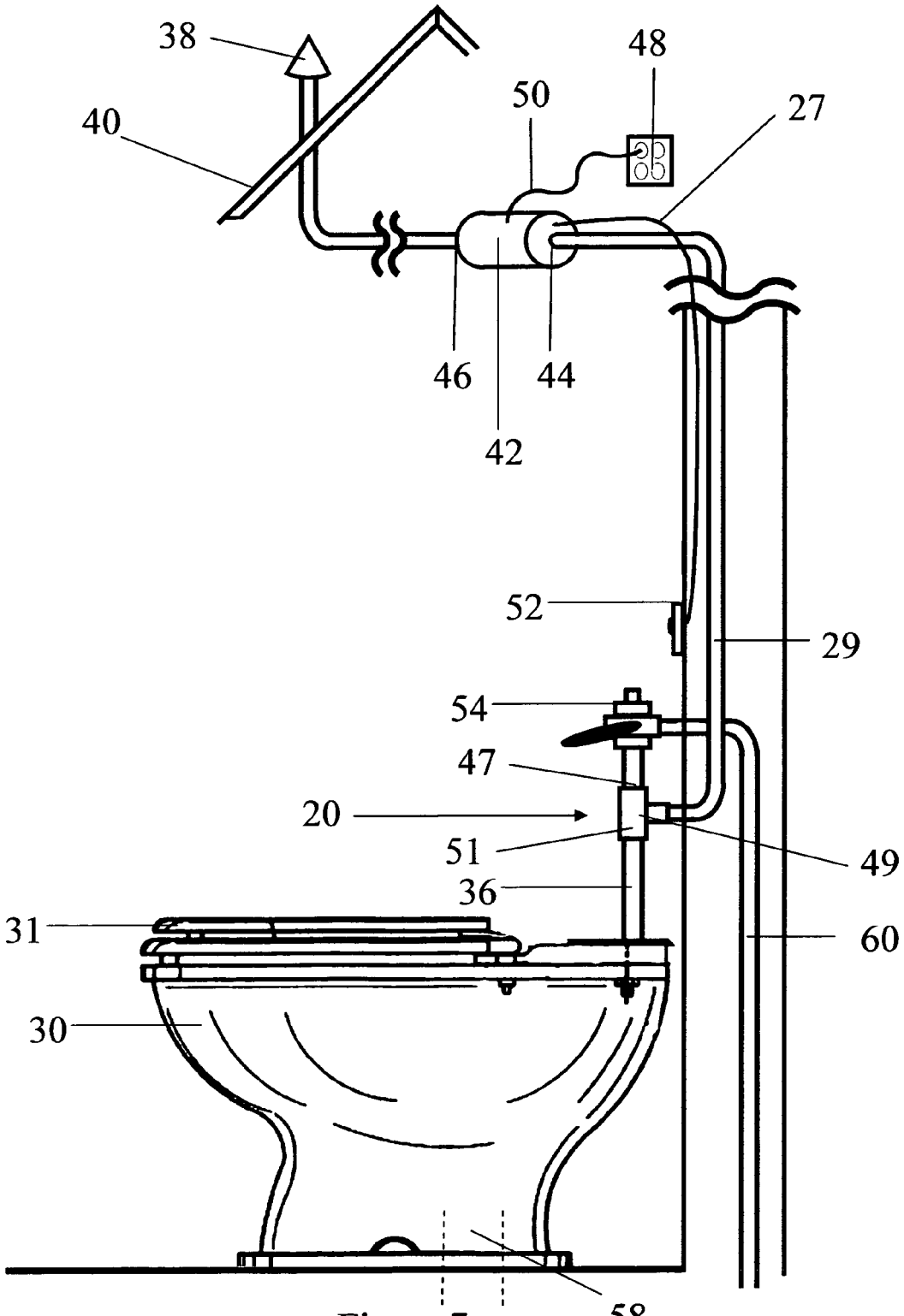
FIG. 7 shows a cross sectional side view of the preferred embodiment of a ventilation fitting utilized within a tank-less toilet configuration.

FIG. 7 depicts a cross sectional side view of the ventilation fitting 20, utilized as FIG. 6 but within a tank-less toilet 30 configuration with an attached toilet seat 31.

Figure 8:
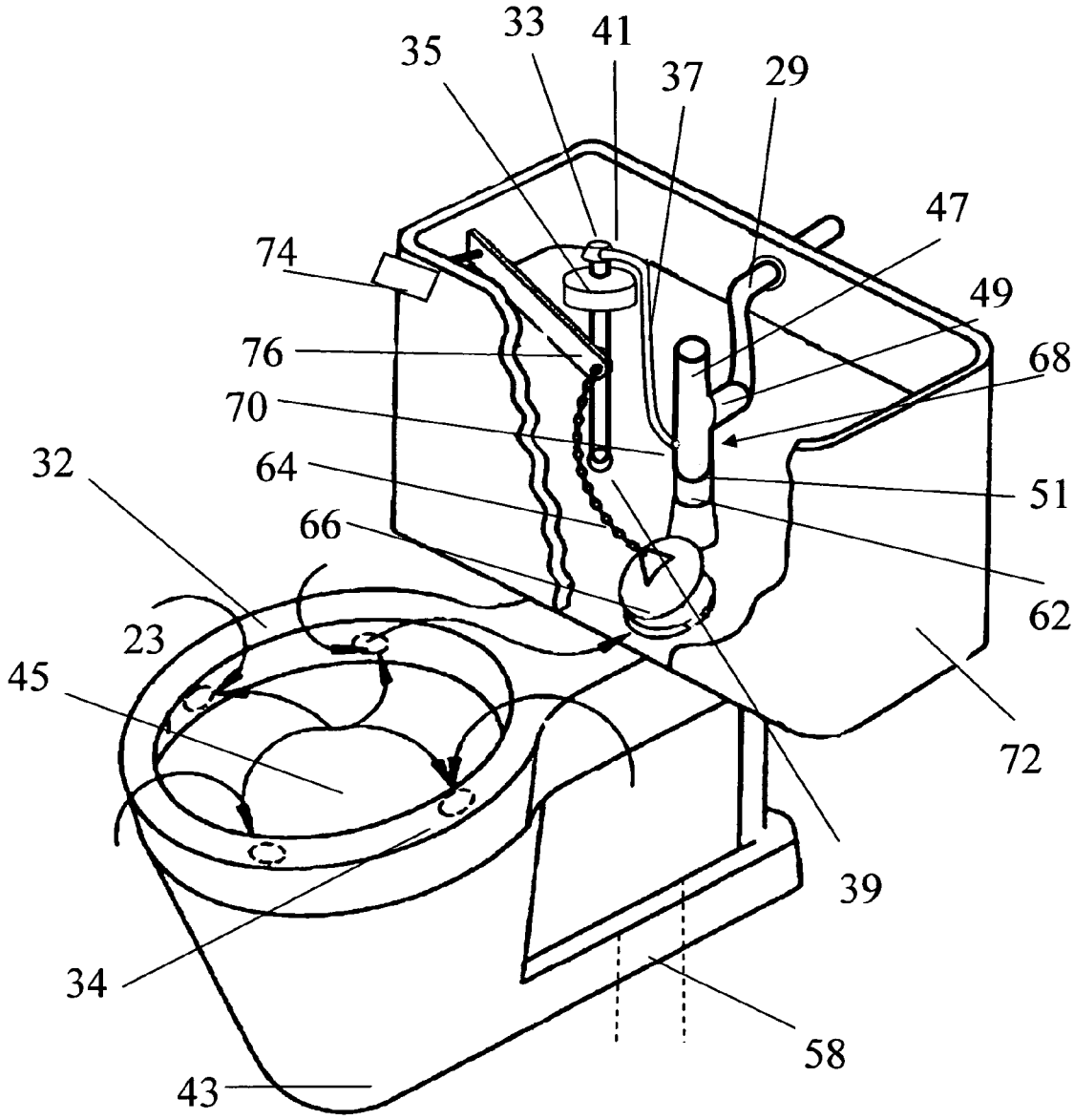
FIG. 8 shows an angled perspective of a ventilation fitting—alternate A fluidly connected to an overflow tube utilized with a tank-including toilet.

FIG. 8 shows an angled perspective of the ventilation fitting—alternate A 68 fluidly connected to an overflow tube utilized within a tank-included toilet 43 configuration. The ventilation fitting—alternate A 68 bidirectional port 51 is fluidly connected to an overflow tube 62 fluidly connected to the flush passage 36 (shown in FIG. 12) a plurality of rim holes 34 and a waste pipe 58. The ventilation fitting—alternate A 68 is fluidly connected to an overflow tube 62 that is fluidly connected to a flush plunger 66, an attached flush linkage 64, a flush tank lever 76 and flush tank handle 74 that is attached to the flush tank reservoir 72 sidewall. The flush tank reservoir 72 is attached to a fill valve 33 comprising a fill valve inlet 78 (shown in FIG. 9), a fill valve primary outlet 39, fill valve float 35, and a fill valve secondary outlet 41 that is fluidly connected to a fill tube 37. The fill tube 37 is fluidly connected to the inlet port 70 of the ventilation fitting—alternate A 68.

Figure 9:
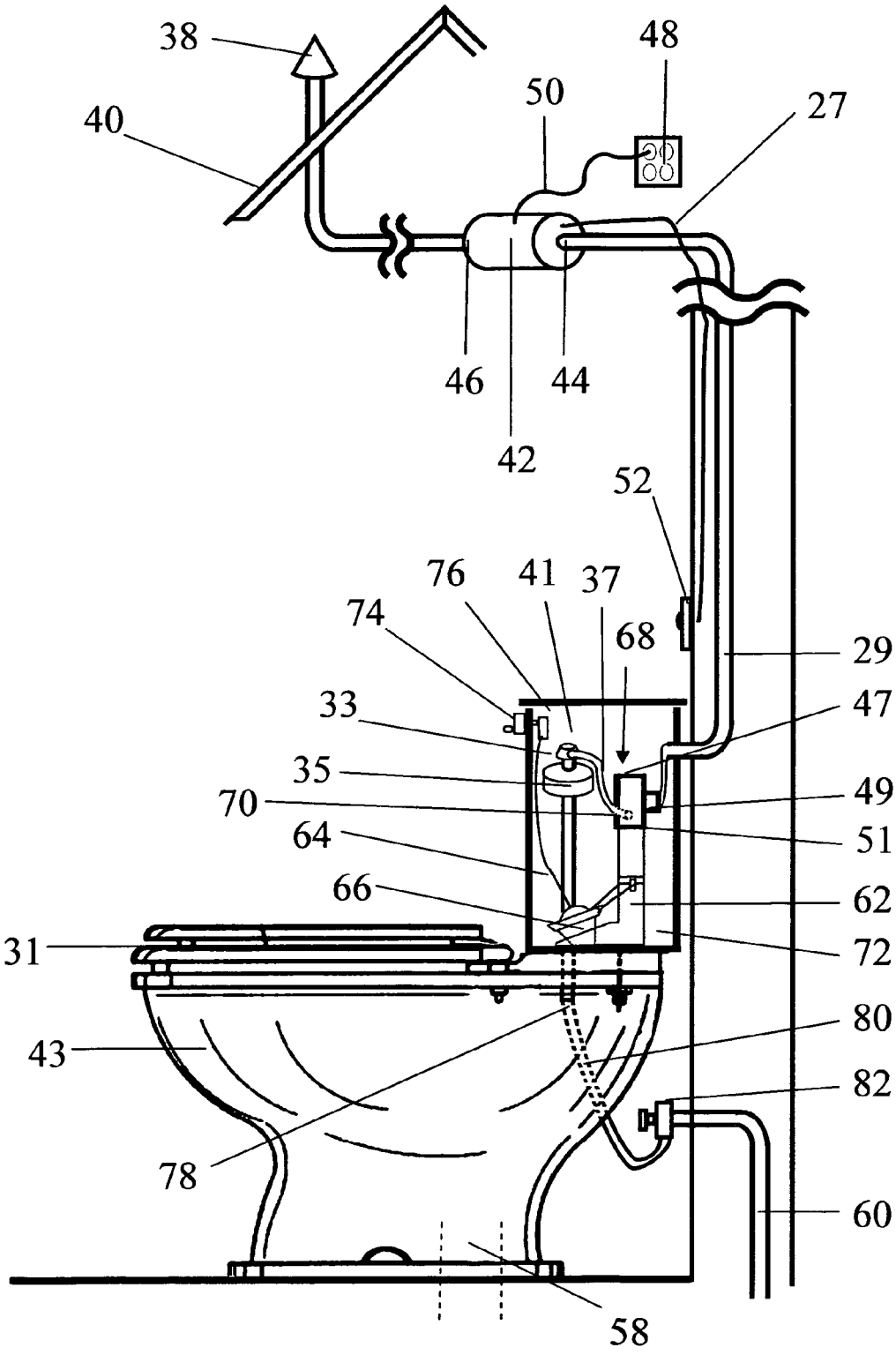
FIG. 9 shows a cross sectional side view of a ventilation fitting—alternate A fluidly connected to an overflow tube utilized with a tank-including toilet.

FIG. 9 depicts a cross sectional side view of the ventilation fitting—alternate A 68 fluidly connected to an overflow tube utilized within a tank-included toilet 43 configuration as shown within FIG. 8 with an attached toilet seat 31 a fill valve inlet 78 fluidly connected to a water hose 80, a shut off valve 82 and a water source pipe 60. The exhaust port 49 is fluidly connected to an exhaust pipe 29 that is attached to an electric fan/blower 42, electric fan/blower inlet port 44 and an electric fan/blower outlet port 46 that is then routed through a roof 40 and connected to an external vent 38. The directional arrows show the evacuation path of a gaseous flow 23. The electric fan/blower 42 has a wired connection to a voltage source 48 using actuation plug A 50 and an actuation interface 52 using actuation plug B 27.

Figure 10:
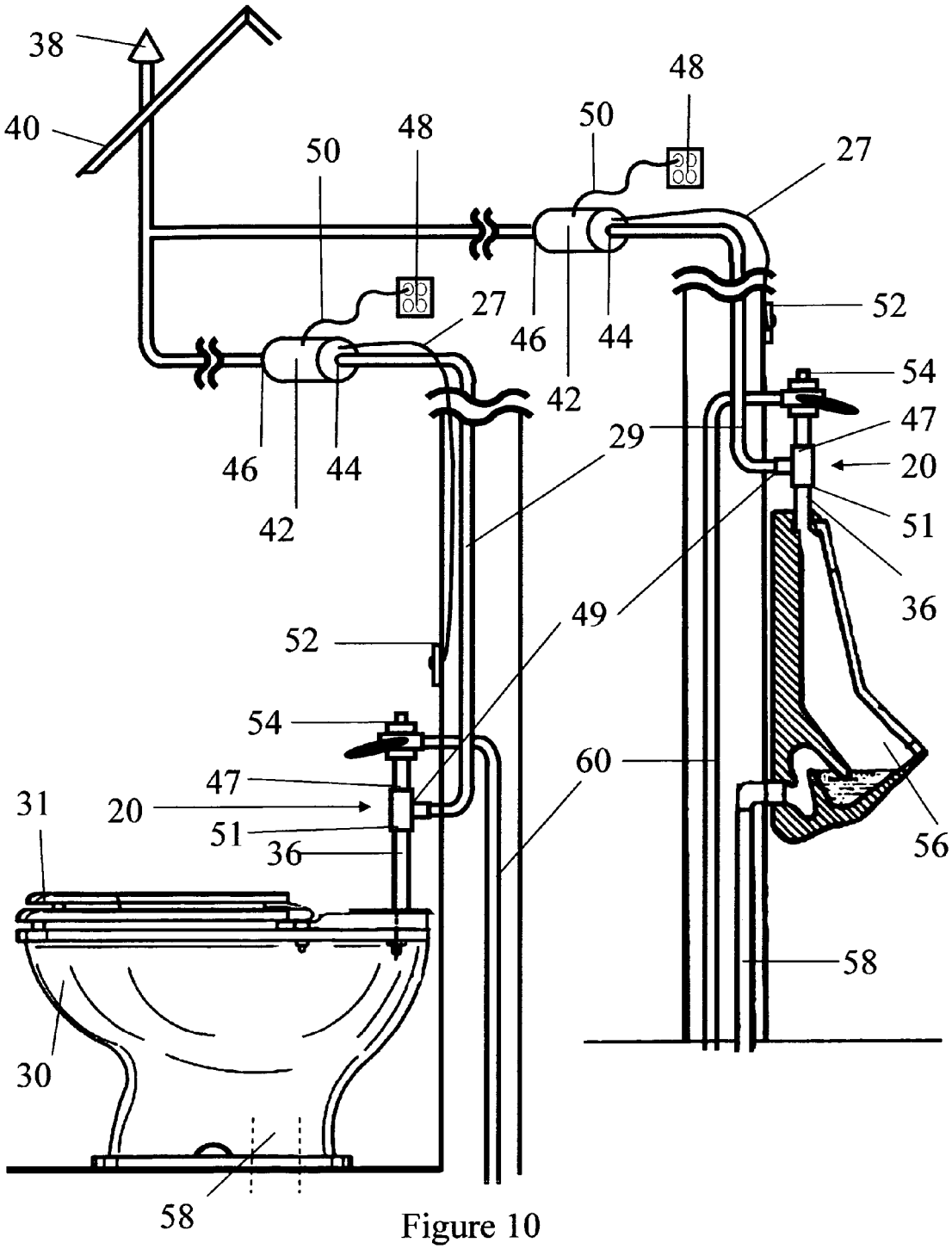
FIG. 10 shows a cross sectional side view of the method for utilizing multiple waste matter receptacles configured using a plurality of electric fan/blower providing independent actuation.

FIG. 10 shows a cross sectional side view of the method for providing independent actuation of multiple waste matter receptacles using a plurality of electric fan/blower and a plurality of preferred ventilation fitting 20 all fluidly connected to the electric fan/blower outlet port 46.

Figure 11:
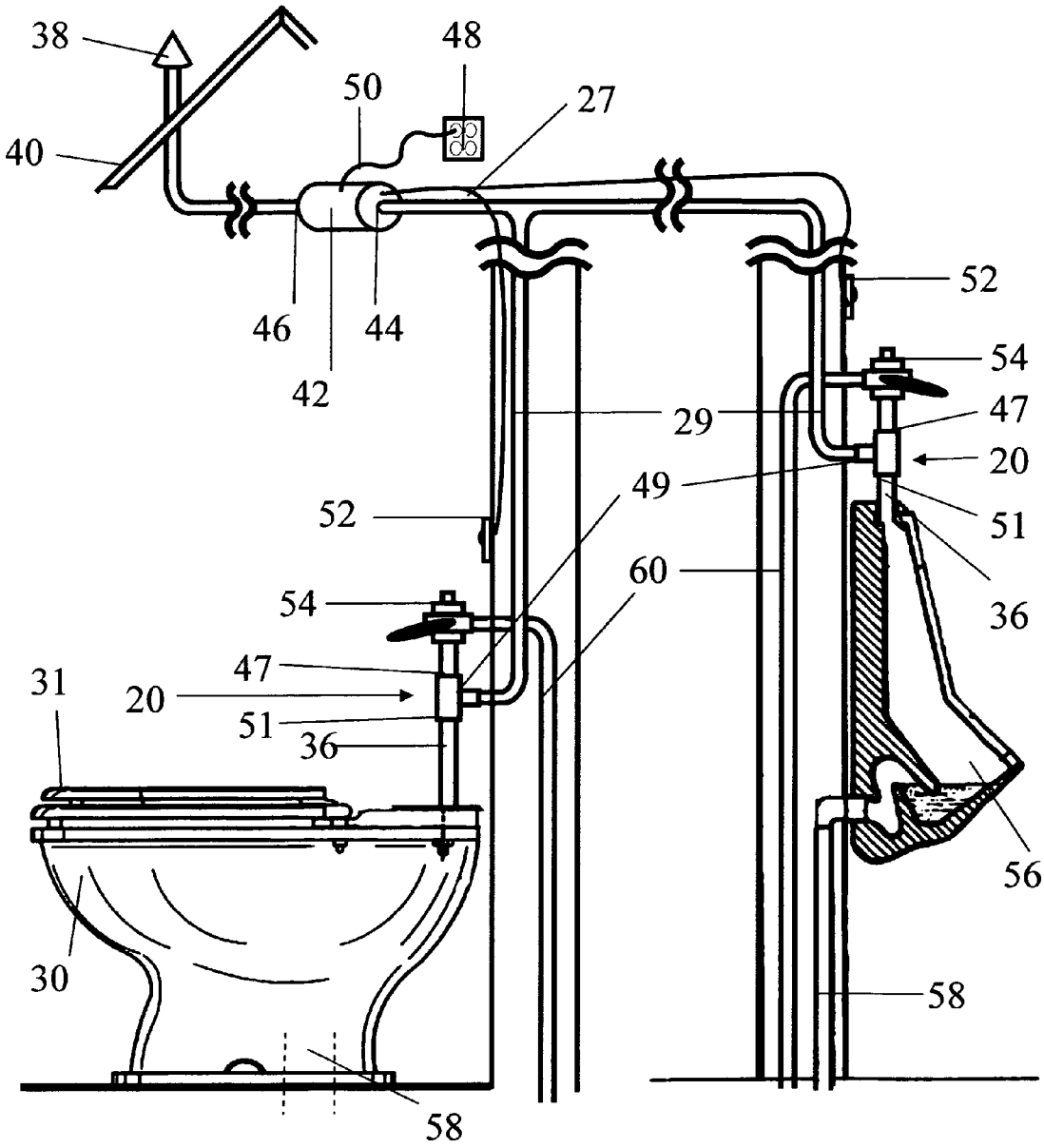
FIG. 11 shows a cross sectional side view of the method for utilizing multiple waste matter receptacles configured a single electric fan/blower providing simultaneous actuation.

FIG. 11 shows a cross sectional side view of the method for providing independent actuation of multiple waste matter receptacles using a plurality of preferred ventilation fitting 20 all fluidly connected to a single electric fan/blower inlet port 44 wherein providing simultaneous actuation.

FIG. 12 depicts an angled perspective of a tank-less toilet 30, that is not a novel feature of this patent application and is similar to other tank-less toilets 30 that are described in the related art (e.g., U.S. Pat. No. 3,192,539 issued to Martz) which has a flush passage 36 that is fluidly connected to a rim 32 and a plurality of rim holes 34 which is also fluidly connected to a waste matter outlet (not shown).

Figure 13:
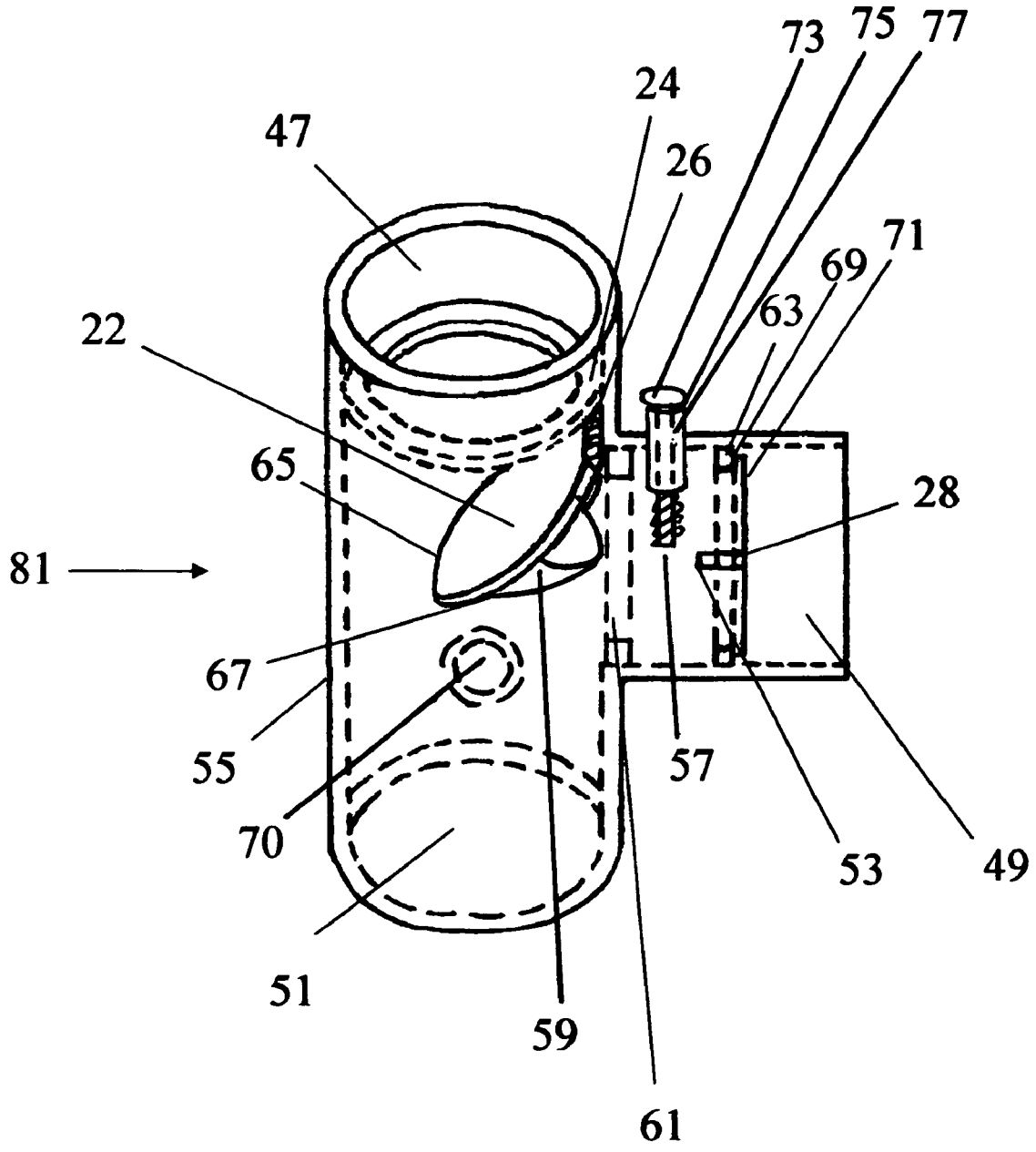
FIG. 13 shows a side cross sectional view of a ventilation fitting—alternate C.

FIG. 13 depicts a side cross sectional view of the ventilation fitting—alternate C 81 further including a fluid inlet port 70.

Operation

Alternative Embodiment.

FIG. 6 and FIG. 7 Urinal 56 and tank-less toilet 30 commercial flush valve 54 is fluidly connected to a ventilation fitting 20. When a user approaches the urinal 56 or the tank-less toilet 30 their presence and/or physical activation with the actuation interface 52 will cause the electric fan/blower 42 to invoke suctorial force on the exhaust pipe 29 and springable guide 53 thus pulling open the snub plate 28 of the ventilation fitting 20 shown in its evacuation state of FIG. 2C thus providing the user with direct odor evacuation through the bidirectional port 51 and the flush passage 36, FIG. 6, shown by the directional gaseous flow 23. This gaseous flow 23 is then pulled towards and through the electric fan/blower 42, an inlet port 44, and outlet port 46 and finally expelled out an external vent 38 located on a roof 40 or other external location thus promoting a clean and odorless experience for the user.

The electric fan/blower 42 is actuated using an actuation plug B 27 wired to an actuation interface 52 which could be any combination of switches, buttons, and/or sensors that will provide electrical actuation for the electric fan/blower 42 and an actuation plug A 50 which is wired to a voltage source 48. When the user flushes the urinal 56 by using the commercial flush valve 54 water is forced from the water source pipe 60 down the ventilation fitting 20 inlet port 47, FIG. 2A, forcing the diverter plate 22 to open and divert the fluid flow 21 past the exhaust port 49 and through the bidirectional port 51 and flush passage 36, FIG. 6, then into the waste pipe 58. As the flushing cycle ends and the pressure of the fluid flow 21 decreases and the springable hinge 26, FIG. 2B, can force the diverter plate 22 to close on the inlet port seat 24. The closing of the diverter plate allows invoked suctorial force on the exhaust pipe 29 by the electric fan/blower 42 to pull open the snub plate 28 and once again provide the user with direct odor evacuation.

FIG. 8 and FIG. 9 depicts a tank-less toilet 30 configuration fluidly connected to a flush passage 36 (shown in FIG. 12) rim holes 34 and waste pipe 58. Ventilation fitting—alternate A 68, an inlet port 47 and bidirectional port 51 is fluidly connected to an overflow tube 62. Exhaust pipe 29 entry point is directly ran into the tank reservoir 72 and fluidly connected to a springable guide 53 and then the exhaust port 49. When a user approaches the tank-less toilet 30 their presence and/or physical activation with the actuation interface 52 will cause the electric fan/blower 42 to invoke suctorial force on the exhaust pipe 29 and springable guide 53 thus pulling open the snub plate 28, FIG. 3, of the ventilation fitting—alternate A 68 thus providing the user with direct odor evacuation through the bidirectional port 51 shown by the directional gaseous flow 23 through the flush passage 36 shown in FIG. 12.

This gaseous flow 23 is then pulled towards and through the electric fan/blower 42, FIG. 9, inlet port 44, and electric fan/blower outlet port 46 and finally expelled out an external vent 38 located on a roof 40 or other external location thus promoting a clean and odorless experience for the user. The electric fan/blower 42 is actuated using an actuation plug B 27 wired to an actuation interface 52 which could be any combination of switches, buttons, and/or sensors that will provide electrical actuation for the electric fan/blower 42 and an actuation plug A 50 which is wired to a voltage source 48. When the user flushes the tank-less toilet 30 by using a flush tank handle 76 the connecting flush tank lever 76 then pulls open a flush plunger 66 by its connecting linkage 64. Therefore, the stored water in the flush tank reservoir 72 is drained into the tank-less toilet 30 flush passage 36, FIG. 6, then into the waste pipe 58.

As the water level in the flush tank reservoir 72, drops a fill valve float 35 actuates its fill valve 33 to refill the tank reservoir 72 through its two outlets. A water source 60 shut off valve 82 and water hose 80 provides the fill valve 33 with water via the fill valve inlet 78. when actuated the fill valve 33 forces water through the primary outlet 39 and secondary outlet 41 until the valve float 35 is brought to the appropriate water height which at that point will shut off water pressure to the primary outlet 39 and secondary outlet 41. As the fill valve 33 is filling the tank reservoir 72 the fill valve secondary outlet 41 forces water through a fill tube 37 into the ventilation fitting—alternate A 68 inlet port 70 which is fluidly connected to a bi-directional port 51, a overflow tube 62, and flush passage 36, FIG. 6, which provides a path for water to replenish and collect in the tank-less toilet 30 for its next use.

During the flush/refill cycle, the exhausted gaseous flow 23 drawn through the flush passage 36 is replaced with a fluid flow 21 that cannot be sucked into the ventilation fitting—alternate A 68, FIG. 3, because the applied suctorial pressure is only strong enough to draw air not water up the overflow tube 62. In case water continues to fill the tank reservoir 72 above the desired water height the excess water will drain down the overflow tube 62 ventilation fitting—alternate A 68 inlet port 47, FIG. 2A, forcing the diverter plate 22 to open and divert the fluid flow 21 past the exhaust port 49 and through the bidirectional port 51 and flush passage 36, FIG. 6, then into the tank-less toilet 30 and waste pipe 58. When the overflowing water subsides the pressure of the fluid flow 21, FIG. 2A, decreases and the springable hinge 26, FIG. 2B, can force the diverter plate 22 to close on the inlet port seat 24.

The closing of the diverter plate allows invoked suctorial force on the exhaust pipe 29 by the electric fan/blower 42 to pull open the snub plate 28 and once again provide the user with direct odor evacuation.

FIG. 10 is an example of where multiple electric fan/blower 42, are installed to provide restroom users with an odor free experience when multiple waste matter receptacles are installed. With the installation of either the ventilation fitting 20 or ventilation fitting—alternate A 68, FIG. 9, in their respectable configurations the snub plate 28, FIG. 2C, will prevent any backflow issues that could be present within the exhaust pipe 29 since this valves orientation assures that only malicious odor is exhausted from the waste matter receptacles. Operational scenarios for this multiple blower with multiple waste matter receptacle installations are when it is necessary to divide multiple restroom facilities into groups, such as apartments, and then aggregate the collected malicious odor into a single external vent 38.

Each divided group then has its own multitude of configurations that could be implemented thereafter. As such, this configuration gives the added flexibility for high scale use in multiple family homes, multiple floor/unit apartments, and large-scale commercial buildings. In addition, if for every waste matter receptacle an electrical fan motor/blower 42 is installed then the electric fan actuation interfaces 52 operation will provide actuation for only a single waste matter receptacle in use. Thus with a multiple waste matter receptacle configuration the multiple exhaust pipes 29 present would then be aggregated into a single external vent 38. FIG. 10 shows a cross sectional side view of one out of a multitude of configurations that the waste matter receptacle ventilation system is capable of but for figure simplicity only two electric fan/blower 42 and two commercial flush valve 54 receptacle configurations are used and should not be seen as a limitation of the systems capability.

FIG. 11 is an example of where only one electric fan/blower 42 is installed to provide restroom users with an odor free experience even if multiple waste matter receptacles are installed. With the installation of either the ventilation fitting 20 or ventilation fitting—alternate A 68, FIG. 9, in their respectable configurations the snub plate 28, FIG. 2C, will prevent any backflow issues that could be present within the exhaust pipe 29 since this valves orientation assures that only malicious odor is exhausted from the waste matter receptacles. Possible operational scenarios for this single blower with multiple waste receptacle installations are used when it is acceptable for multiple electric fan actuation interfaces 52 to control a single electric fan/blower 42 which when actuated would apply suctorial pressure to all waste receptacles even waste receptacles that are not in use.

As such, this configuration could be used in single-family homes, apartments, and/or stores where this operation was acceptable. FIG. 11 shows a cross sectional side view of one out of a multitude of configurations that the waste matter receptacle ventilation system is capable of but for figure simplicity only one electric fan/blower 42 and two commercial flush valve 54 receptacle configurations are used and should not be seen as a limitation of the systems capability.

FIG. 12 depicts an angled perspective of a tank-less toilet 30 comprising a flush passage 36, a rim 32, and a plurality of rim holes 34, which is fluidly connected to a waste matter outlet (not shown). When the tank-less toilet 30 is within a flushing state the fluid flow 21 is forced through the flush passage 36, which is fluidly connected to a rim 32, and a plurality of rim holes 34 that provides the flushing capabilities of a tank-less toilet. When the toilet is not within a flushing state the flush passage 36, rim 32, and rim holes 34 are free of water giving the capability to use the flush passage 36 in reverse direction for evacuating malicious odor.

FIG. 13 depicts a side cross sectional view of the ventilation fitting—alternate C 81 providing additional functionality to the ventilation fitting 20 as to provide a direct channel for the input of water into the main body 55 using the fluid inlet port 70.

CONCLUSION, RAMIFICATIONS, AND SCOPE

This invention relates to the direct evacuation of malicious odor found within restroom toilets and urinals. This design is aesthetically appealing, multi-usable, professional grade solution that provides the removal of malicious odors from standard toilet bowls and urinals while not requiring additional routine maintenance or reoccurring filter costs further promoting a clean healthy hassle-free restroom facility. Moreover, this invention removes the prior art necessity of requiring a localized power source and provides protection against water from being drawn into the electrical exhaust system further protecting users from health hazards during operation Additionally, by removing the possibility of backflowing odor within shared exhaust systems multiple inline unit configurations can be achieved providing a no-nonsense cost-effective commercial integration into hotels, apartment complexes, and large-scale commercial buildings and developments.

Although the descriptions and figures in the above specification should not be construed as to limit the scope of the invention but as merely providing descriptions and illustrations of some of the embodiments of this invention. For example, the ventilation fitting 20 shown in FIG. 1 could have the snub plate 28 removed effectively eliminating the backflow protection which gives this invention its commercial scalability but could be sustained if a similar control was moved to another location inline within the exhaust path. Additionally, this backflow control could be integrated into the electrical fan/blower inlet port 44 or within the exhaust pipe 29 thus providing the same breath of backflow protection. Also the ventilation fitting—preferred 20 could be shaped such as a square, circular, oval, wherein different connecting means could be used such as snapping, gluing, screw type, etc thus the scope of the invention should be determined by the appended claims and their legal equivalents, rather than by the examples given.

We claim:

1. A ventilation fitting permitting the removal of gas within a fluid line that has non-contiguous fluid transmission comprising:

a main body tubular in shape extending between a plurality of ports including an inlet port an exhaust port and a bidirectional port and a plurality of sealing seats including a snub plate seat an inlet port seat and an exhaust port seat, said exhaust port for coupling to an exhaust pipe provides a fluidly connected channel for traversing gases through;

a diverter plate including an upper surface and a lower surface, wherein said diverter plate uses both said upper surface and said lower surface to fluidly seal both said inlet port and said exhaust port by seating the upper and lower surfaces of said diverter plate to said inlet port seat and said exhaust port seat respectively, and wherein said diverter plate is springably hinged to said main body providing resilient seating actuation between said upper surface of said diverter plate and said inlet port seat further promoting both a fluidly closed said inlet port and a fluidly connected channel existing between said bidirectional port and said exhaust port to traverse gases through when said inlet port is devoid of fluid pressure and as fluid pressures increase against said upper surface within said inlet port further counteracting spring equilibrium said diverter plate is forced into seated position between said lower surface and said exhaust port seat providing a fluidly connected channel existing between said inlet port and said bidirectional port to traverse fluid through; and a snub plate with an interior facing surface and an exterior facing surface, wherein said snub plate is springably attached to said main body providing resilient seating actuation between said interior facing surface of said snub plate and said snub plate seat allowing for a sealed blockage point from gases entering into said main body through said exhaust port while back-flowing gases from said exhaust pipe will apply pressure onto said exterior facing surface further sealing said snub plate within said snub plate seat and as suctorial pressure applied from said exhaust pipe draws gases from said exhaust port applying increasing suctorial pressure on said exterior facing surface further counteracting spring equilibrium said snub plate is forced open unseating said interior facing surface from said snub plate seat providing a fluidly connected channel existing between said bidirectional port and said exhaust pipe to traverse gases through;

whereby said diverter plate directs fluid and gas to appropriate ports providing a flushing state and evacuation state while said snub plate eliminates backflow pressure from entering said bidirectional port, whereby permitting the removal of gas within a fluid line without causing further contamination within the connecting fluid line.

2. The ventilation fitting of claim 1 further including a release port a release lid a release lid seat a plunger and a plunger actuator, said release port fluidly position within wall of said exhaust port further positioned more inwardly towards said exhaust port seat in comparison to said snub gate, said plunger and said release lid are connected and springably affixed to said main body while positioned within rotational proximity from said plunger actuator affixed upon said lower surface of said diverter plate, wherein said release lid and said release lid seat are normally within a seated position providing suctorial pressure to remain constant within said main body and as fluid flow pressures increase against said upper surface forcing said diverter plate into seated position upon said exhaust port seat said plunger actuator depresses said plunger forcing said release lid away from said release seat providing a fluidly connected channel existing between said exhaust port and atmospheric pressures equalizing the suctorial pressure within said exhaust port promoting the springably hinged diverter plate to overcome suctorial pressures and return to normally opened position seated within said inlet port seat, whereby suctorial pressures are regulated providing said diverter plate to operate independently of applied suctorial force, whereby allowing said diverter plate to not be lodged in a undesired position from excessive and constant suctorial forces.

3. The ventilation fitting of claim 2 wherein the angle between said inlet port and said exhaust port is between 15 and 165 degrees.

4. The ventilation fitting of claim 3 further including a fluid inlet port to allow the unrestricted entry of fluid into said main body and expelled through said bidirectional port.

5. The ventilation fitting of claim 1 wherein the angle between said inlet port and said exhaust port is between 15 and 165 degrees.

6. The ventilation fitting of claim 5 further including a fluid inlet port to allow the unrestricted entry of fluid into said main body and expelled through said bidirectional port.

7. A ventilation fitting providing the capability to remove gas within a fluid line which has non-contiguous fluid transmission comprising:

a main body tubular in shape extending between a plurality of ports including an inlet port an exhaust port and a bidirectional port and a plurality of sealing seats including a snub plate seat an inlet port seat and an exhaust port seat, said exhaust port for coupling to an exhaust pipe providing a fluidly connected channel for traversing gas through;

a diverter plate which resiliently seals said inlet port seat closing said inlet port when said inlet port is devoid of fluid pressure providing a fluidly connected channel existing between said exhaust port and said bidirectional port to traverse gases through and as fluid pressures increase within said inlet port said diverter plate will unseat from said inlet port seat opening said inlet port and seal against said exhaust port seat providing a fluidly connected channel existing between said inlet port and said bidirectional port to traverse fluid through; and a snub plate which resiliently seals against said snub plate seat and provides a blockage point from gases entering into said main body through said exhaust port and as suctorial pressure applied from said exhaust pipe increases drawing pressure from said exhaust port into said exhaust pipe said snub plate will unblock and unseat from said snub plate seat further providing a fluidly connected channel existing between said bidirectional port and said exhaust pipe to traverse gases through;

whereby said diverter plate directs fluid and gas to appropriate ports providing a flushing state and evacuation state while said snub plate eliminates backflow pressure from entering into said bidirectional port, whereby permitting the removal of gas within a fluid line without causing further contamination within the connecting fluid line.

8. The ventilation fitting of claim 7 further including: a release lid to actuate and regulate the suctorial pressure within said exhaust port and suctorial forces upon said diverter plate by providing controlled actuation between said exhaust port and atmospheric pressures further equalizing suctorial pressure within said exhaust port allowing for said diverter plate to operate independently of applied suctorial force, whereby allowing said diverter plate to not be lodged into an undesired position from excessive and constant suctorial forces.

9. The ventilation fitting of claim 8 wherein the angle between said inlet port and said exhaust port is between 15 and 165 degrees.

10. The ventilation fitting of claim 9 further including a fluid inlet port to allow for unrestricted entry of fluid into said main body and expelled through said bidirectional port.

11. The ventilation fitting of claim 7 wherein the angle between said inlet port and said exhaust port is between 15 and 165 degrees.

12. The ventilation fitting of claim 11 further including a fluid inlet port to allow for unrestricted entry of fluid into said main body and expelled through said bidirectional port.

13. A method for evacuating gas within waste matter receptacles, comprising:

providing waste matter receptacle means, including a water source pipe a flush passage a rim with a plurality of rim holes a waste cavity and a waste pipe, for collecting and discarding human waste from said waste cavity into said waste pipe by providing flush actuation means which forces fluid into said flush passage further traversing through said rim said plurality of rim holes into said waste cavity then into said waste pipe;

providing a ventilation fitting fluidly connected inline to said flush passage of said waste matter receptacle means and a exhaust pipe permitting the removal of gas from said flush passage while preventing the contamination of said flush passage from back-flowing gas pressure present within said exhaust pipe, said ventilation fitting comprising:

a main body tubular in shape extending between a plurality of ports including an inlet port an exhaust port and a bidirectional port and a plurality of sealing seats including a snub plate seat an inlet port seat and an exhaust port seat, said exhaust port for coupling to an exhaust pipe providing a fluidly connected channel for traversing gas through;

a diverter plate which resiliently seals said inlet port seat closing said inlet port when said inlet port is devoid of fluid pressure providing a fluidly connected channel existing between said exhaust port and said bidirectional port to traverse gases through and as fluid pressures increase within said inlet port said diverter plate will unseat from said inlet port seat opening said inlet port and seal against said exhaust port seat providing a fluidly connected channel existing between said inlet port and said bidirectional port to traverse fluid through;

a snub plate which resiliently seals against said snub plate seat and provides a blockage point from gases entering into said main body through said exhaust port and as suctorial pressure applied from said exhaust pipe increases drawing pressure from said exhaust port into said exhaust pipe said snub plate will unblock and unseat from said snub plate seat further providing a fluidly connected channel existing between said bidirectional port and said exhaust pipe to traverse gases through;

a release lid to actuate and regulate the suctorial pressure within said exhaust port and suctorial forces upon said diverter plate by providing controlled actuation between said exhaust port and atmospheric pressures further equalizing suctorial pressure within said exhaust port allowing for said diverter plate to operate independently of applied suctorial force;

providing evacuation means, including a exhaust pipe a voltage source coupled to an electric fan/blower and a external vent, for venting and disposing of gases from said waste matter receptacle to a desired isolated location by providing a system actuation means of said electric fan/blower further providing forces to evacuate gases from said waste cavity into said plurality of rim holes within said rim into said flush passage further flowing into said bidirectional port of said ventilation system further traversing said snub plate and said exhaust port into said exhaust pipe further expelled from said external vent within a desired isolated location;

whereby said waste matter receptacle means provides a fluidly connected channel between said waste cavity and said flush passage further providing said ventilation fitting the capability to flush fluid and draw gas therein, whereby said diverter plate directs fluid and gas to appropriate ports providing a flushing state and evacuation state while said snub plate eliminates backflow pressure from entering into said bidirectional port while allowing said first means to not be lodged into an undesired position from excessive and constant suctorial forces further allowing said ventilation fitting to fully function independently of said evacuation means, said ventilation fitting provides a fluidly connected channel linking between said waste matter receptacle means and said evacuation means which allows the evacuation of gas from waste mater receptacles, whereby said evacuation means provides for actuation of suctorial forces applied within a fluidly connected channel between said waste cavity and said exhaust pipe, whereby said method of gas evacuation from said waste matter receptacle means will be expelled to a desired isolated location while backflow protection will prevent contamination from traversing back therein.

14. The method of claim 13 wherein said waste matter receptacle means is a urinal while said flush actuation means is a commercial flush valve that is fluidly connected to said inlet port of said ventilation fitting while said bidirectional port is fluidly connected to said flush passage of specified urinal.

15. The method of claim 13 wherein said waste matter receptacle means is a tank-less toilet while said flush actuation means is a commercial flush valve that is fluidly connected to said inlet port of said ventilation fitting while said bidirectional port is fluidly connected to said flush passage of specified tank-less toilet.

16. The method of claim 13 wherein said waste matter receptacle means is a tank-included toilet while said flush actuation means comprising: a flush tank handle connecting a flush tank lever to a flush linkage for operation of a flush plunger within a overflow tube that is fluidly connected to said bidirectional port of said ventilation fitting while said inlet port is left fluidly open to allow for overflowing water to enter and drain into said inlet port while a fill valve is used to fill water levels therein and directly supply water to a fluid inlet port of said ventilation fitting.

17. The method of claim 13 further including a plurality of combinational instances of said waste matter receptacle means with said ventilation fitting installed therein further being fluidly attached to and combined at an electric fan/blower outlet port allowing the use of one said exhaust vent providing each included combinational instance the ability to actuate independently from each other.

18. The method of claim 13 further including a plurality of combinational instances of said waste matter receptacle means with said ventilation fitting installed therein further being fluidly attached to and combined at an electric fan/blower inlet port allowing the use of one said electric fan/blower providing all included combinational instance to actuate simultaneously together.

19. The ventilation fitting of claim 13 wherein the angle between said inlet port and said exhaust port of said ventilation fitting is between 15 and 165 degrees.

20. The ventilation fitting of claim 13 wherein the angle between said inlet port and said exhaust port of said ventilation fitting is 90 degrees.

* * * * *